US012638191B2

(12) United States Patent
Tang et al.

(10) Patent No.: US 12,638,191 B2
(45) Date of Patent: May 26, 2026

(54) CONSTANT-TEMPERATURE WATER SUPPLY SYSTEM EMPLOYING CARBON DIOXIDE HEAT PUMP, AND CONTROL METHOD THEREFOR

(71) Applicant: JIANGSU SUJING GROUP CO., LTD., Suzhou (CN)

(72) Inventors: Xiaoliang Tang, Suzhou (CN); Dan Xiong, Suzhou (CN); Hao Pan, Suzhou (CN); Jun You, Suzhou (CN); Danong Zhou, Suzhou (CN); Qiang Kang, Suzhou (CN); Xiaofei Song, Suzhou (CN)

(73) Assignee: Jiangsu Sujing Group Co., Ltd., Suzhou (CN)

( * ) Notice: Subject to any disclaimer, the term of this patent is extended or adjusted under 35 U.S.C. 154(b) by 540 days.

(21) Appl. No.: 17/906,970

(22) PCT Filed: Dec. 31, 2020

(86) PCT No.: PCT/CN2020/142098

§ 371 (c)(1),
(2) Date: Sep. 21, 2022

(87) PCT Pub. No.: WO2021/227538

PCT Pub. Date: Nov. 18, 2021

(65) Prior Publication Data

US 2023/0106610 A1 Apr. 6, 2023

(30) Foreign Application Priority Data

May 9, 2020 (CN) ..... 202010386408.2

(51) Int. Cl.
*F24D 17/02* (2006.01)
*F24D 19/10* (2006.01)

(52) U.S. Cl.
CPC ..... *F24D 17/02* (2013.01); *F24D 19/1054* (2013.01); *F24D 2200/12* (2013.01)

(58) Field of Classification Search
USPC ..... 122/13.01
See application file for complete search history.

(56) References Cited

U.S. PATENT DOCUMENTS

2011/0139259 A1* 6/2011 Nagata ..... F24D 17/02 122/13.01
2012/0255507 A1* 10/2012 Fushiki ..... F24D 17/0078 392/441
2015/0159960 A1* 6/2015 Fujitsuka ..... F24D 17/0078 165/10

FOREIGN PATENT DOCUMENTS

CN 102652244 A 8/2012
CN 103673295 A 3/2014
(Continued)

OTHER PUBLICATIONS

International Search Report and Written Opinion issued for International Patent Application No. PCT/CN2020/142098, dated Mar. 29, 2021.

*Primary Examiner* — Steven B McAllister
*Assistant Examiner* — John E Bargero
(74) *Attorney, Agent, or Firm* — Knobbe, Martens, Olson & Bear, LLP

(57) ABSTRACT

A constant-temperature water supply system employing a carbon dioxide heat pump includes a primary side loop, a secondary side water supply pipeline, a carbon dioxide heat pump water heater in the primary side loop, and a heat exchanger between the primary side loop and the secondary side water supply pipeline; the temperature of return water is detected and the temperature of a return water tank is detected, so even if the temperature of return water flowing out of a first heat exchange tube fluctuates, the return water
(Continued)

can be input at a position in the return water tank having a close temperature, such that water in the return water tank is always in a stably layered state, and therefore allows for constant-temperature water supply.

14 Claims, 1 Drawing Sheet

(56) References Cited

FOREIGN PATENT DOCUMENTS

| | | | | |
|---|---|---|---|---|
| CN | 204665748 | U | 9/2015 | |
| CN | 206496408 | U | 9/2017 | |
| CN | 107796040 | A | 3/2018 | |
| CN | 111550862 | A | 8/2020 | |
| EP | 1450110 | A2 * | 8/2004 | ..... F24D 17/02 |
| JP | 2005-114268 | A | 4/2005 | |
| JP | 2006-329569 | A | 12/2006 | |

* cited by examiner

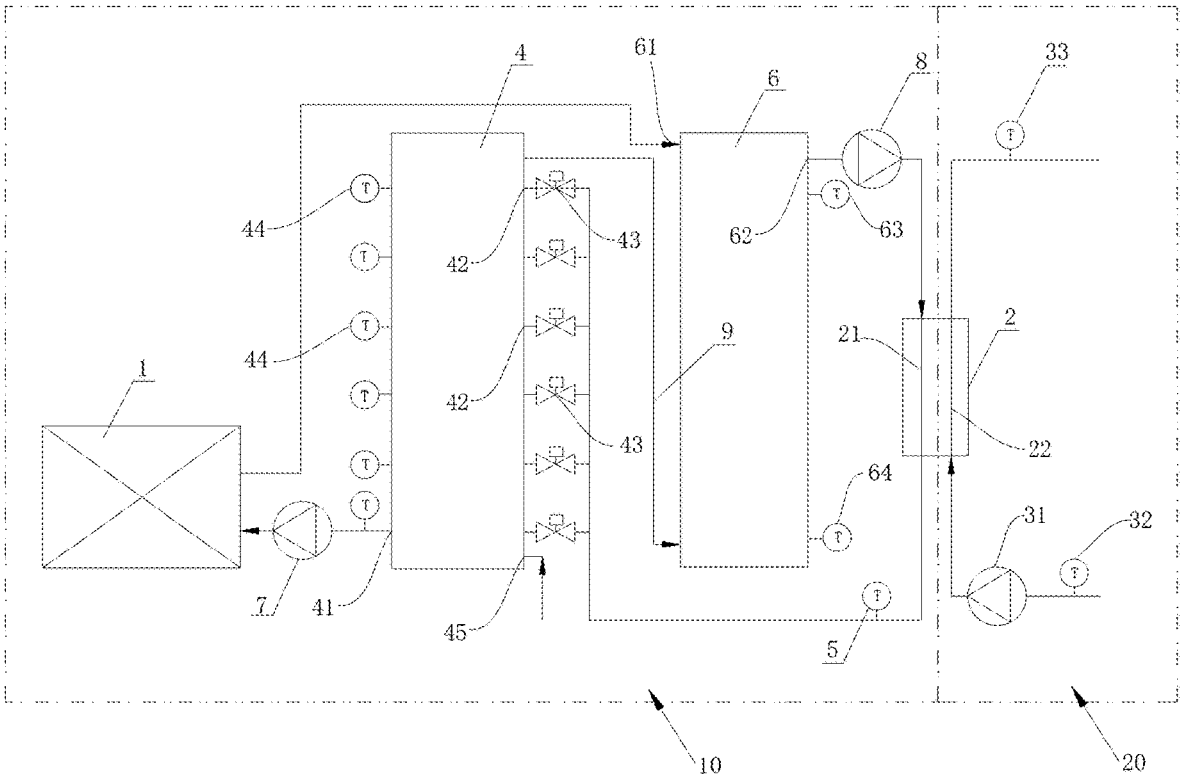
4
61
6
8
33
44
42
43
62
63
44
42
43
9
21
2
1
22
64
31
32
7
41
45
5
10
20

CONSTANT-TEMPERATURE WATER SUPPLY SYSTEM EMPLOYING CARBON DIOXIDE HEAT PUMP, AND CONTROL METHOD THEREFOR

CROSS REFERENCE TO RELATED APPLICATION(S)

This application is a U.S. National Phase under 35 U.S.C. § 371 of International Application PCT/CN2020/142098, filed Dec. 31, 2020, which claims priority from Chinese Patent Application No. 202010386408.2 filed with the China Patent Office on May 9, 2020, each of which is incorporated herein by reference in its entirety.

TECHNICAL FIELD

The present disclosure relates to a constant-temperature water supply system employing a carbon dioxide heat pump, and a control method therefor.

BACKGROUND

When a heat pump water heater is used in a secondary heat exchange system, a temperature of a primary side return water is greatly affected by change of a water temperature and flow rate of a secondary side; if the primary side return water is directly introduced into the heat pump water heater for reheating, due to the change of the temperature of the primary side return water can easily lead to a fluctuation of the outlet water temperature, the system is unstable; and the energy efficiency of the heat pump system is greatly affected by an inlet water temperature on an air cooler side, when the inlet water temperature on the air cooler side is too high, the exhaust temperature and exhaust pressure are too high, the compressor is large and will be overloaded easily, the energy efficiency of the system will be significantly reduced, and the stability of the system will be affected to a certain extent.

Accordingly, at present, a constant-temperature water supply system employing a carbon dioxide heat pump is desired.

SUMMARY

The present disclosure is aimed at providing a constant-temperature water supply system employing a carbon dioxide heat pump.

To achieve the above purpose, a technical solution employed by the present disclosure is: A constant-temperature water supply system employing a carbon dioxide heat pump, comprises a primary side loop, a secondary side water supply pipeline having a water inlet and a water outlet, a heat pump water heater provided in the primary side loop, and a heat exchanger provided between the primary side loop and the secondary side water supply pipeline, the heat exchanger comprises a first heat exchange tube and a second exchange tube arranged to exchange heat with each other, the first heat exchange tube is arranged in the primary side loop, the second heat exchange tube is arranged in the secondary side water supply pipeline, the primary side loop and the secondary side water supply pipeline are connected to each other in a heat exchange manner through the heat exchanger, the primary side loop further comprises at least one vertically arranged return water tank, a bottom of the return water tank is provided with a return water outlet that communicates with the heat pump water heater, and a side portion of the return water tank is provided with a plurality of return water inlets connected to the heat exchanger in a vertical direction in sequence, each of the return water inlets is provided with a return water valve, the return water tank is provided with a plurality of return water tank temperature sensors for detecting water temperature in the return water tank corresponding to a height of each of the return water inlets, and an outlet of the first heat exchange tube is provided with a return water temperature sensor for detecting the temperature of the water at the outlet of first heat exchange tube.

Preferably, the return water inlets are uniformly distributed in sequence from the bottom of the return water tank to a top of the return water tank.

Preferably, the primary side loop further comprises a water supply tank, and two ends of upper portion of the water supply tank are respectively connected to an outlet of the heat pump water heater and an inlet of the first heat exchange tube.

Further preferably, a lower portion of the water supply tank and an upper portion of the return water tank are arranged in communication with each other via a water pipe.

Further preferably, a water supply temperature sensor is arranged at an outlet end of the water supply tank.

Preferably, a primary side water supply pump is arranged between the return water outlet and the heat pump water heater.

Preferably, the primary side loop is further provided with a primary side circulation pump, and the primary side circulation pump is arranged between the water supply tank and the inlet of the first heat exchange tube.

Preferably, a secondary side inlet water temperature sensor and a secondary side outlet water temperature sensor are respectively arranged at an inlet end and an outlet end of the secondary side water supply pipeline.

Preferably, a water supplement port is arranged at the bottom of the return water tank.

A control method for a constant-temperature water supply system employing a carbon dioxide heat pump, adopting the above-mentioned constant-temperature water supply system, comprises detecting water temperature at the outlet of the first heat exchange tube by the return water temperature sensor, and detecting water temperature at different heights of the return water tank by the plurality of return water tank temperature sensors, and opening a return water valve corresponding to a return water tank temperature sensor whose detected temperature is close to the water temperature detected by the return water temperature sensor to return water.

Due to the use of the above technical solutions, the present disclosure has the following advantages over the prior art:

In the present disclosure, the temperature of return water is detected by a return water temperature sensor, the temperature of the return water tank is detected by a plurality of return water tank temperature sensors, even if the temperature of return water flowing out of the first heat exchange tube fluctuates, the return water can be inputted at a position in the return water tank having a similar temperature, such that water in the return water tank is always in a stably layered state, thereby preventing the temperature of a water flow delivered from the return water tank to the heat pump water heater from fluctuating, and therefore achieving constant-temperature water supply.

BRIEF DESCRIPTION OF THE DRAWINGS

FIG. 1 is a schematic structural diagram of the present disclosure.

In the FIGURE, 1, carbon dioxide heat pump water heater; 2, heat exchanger; 21, first heat exchange tube; 22, second heat exchange tube; 31, secondary side circulation pump; 32, secondary side inlet water temperature sensor; 33, secondary side outlet water temperature sensor; 4, return water tank; 41, return water outlet; 42, return water inlet; 43, return water valve; 44, return water tank temperature sensor; 45, water supplement port; 5, return water temperature sensor; 6, water supply tank; 61, water supply inlet; 62, water supply outlet; 63, water supply temperature sensor; 64, water supply bottom temperature sensor; 7, primary side water supply pump; 8, primary side circulation pump; 9, water pipe; 10, primary side loop; 20, secondary side water supply pipeline.

DETAILED DESCRIPTION OF EXEMPLARY EMBODIMENTS

The present disclosure will be further described combining with embodiments shown in the accompanying drawings, in which:

Referring to FIG. 1, a constant-temperature water supply system employing a carbon dioxide heat pump, comprises a primary side loop 10, a secondary side water supply pipeline 20 having a water inlet and a water outlet, a carbon dioxide heat pump water heater 1 provided in the primary side loop 10, and a heat exchanger 2 provided between the primary side loop 10 and the secondary side water supply pipeline 20.

Specifically, the heat exchanger 2 comprises a first heat exchange tube 21 and a second exchange tube 22 arranged to exchange heat with each other, wherein the first heat exchange tube 21 is arranged in the primary side loop 10, the second heat exchange tube 22 is arranged in the secondary side water supply pipeline 20, and the primary side loop 10 and the secondary side water supply pipeline 20 are connected to each other in a heat exchange manner via the heat exchanger 2.

The primary side loop 10 comprises n return water tanks 4 (only one is shown in the FIGURE) vertically arranged in parallel, the bottom of each return water tank 4 is provided with a return water outlet 41 that communicates with the carbon dioxide heat pump water heater 1, and a side portion of the return water tank 4 is provided with m return water inlets 42 connected to the heat exchanger 2 in the vertical direction in sequence, each return water inlet 42 is provided with a return water valve 43, the return water tank 4 is provided with a plurality of return water tank temperature sensors 44 for detecting the water temperature in the return water tank 4 corresponding to the height of each of the return water inlets 42, the return water tank temperature sensor 44 on the return water tank 4 has n*m groups, and the outlet of the first heat exchange tube 21 is provided with a return water temperature sensor 5 for detecting the temperature of the water at the outlet of the first heat exchange tube 21.

The specific control method for the constant-temperature water supply system of this embodiment is:

1. Detecting the temperature $T_{10}$ of the return water by the return water temperature sensor 5, and detecting the temperature $T_{Ni}$ of the return water tank 4 by the n*m groups of return water tank temperature sensors 44;
2. Comparing $T_{10}$ with $T_{Ni}$, there are three cases: 1) $T_{10}$ is between two adjacent $T_{Ni}$; at this time, opening the return valve 43 corresponding to the return water tank temperature sensor 44 with the lower temperature in the two adjacent $T_{Ni}$, and the primary side return water returns there; 2) $T_{10} \geq$ the maximum value of $T_{Ni}$; at this time, opening the return water valve 43 corresponding to the return water tank temperature sensor 44 with the maximum value of $T_{Ni}$, and the primary side return water returns there; 3) $T_{10} \leq$ the minimum value of $T_{Ni}$; at this time, opening the return water valve 43 corresponding to the return water tank temperature sensor 44 with the minimum value of $T_{Ni}$, and the primary side return water returns there.

For static hot water in a container, since hot water with a higher temperature has a lower density and is in an upper layer, and hot water with a lower temperature has a higher density and is in a lower layer, even when the temperature of the water flow out of the first heat exchange tube 21 fluctuates, in this embodiment, the water flow entering the return water tanks 4 is sent to a water layer with a close temperature according to its temperature, so that the hot water in the return water tanks 4 is always maintain a layered state according to the temperature. When water is injected from the return water inlets 42, hot water with a lower temperature at the lowermost ends of the return water tanks 4 enters the carbon dioxide heat pump water heater 1 from the return water outlets 41 for heating, which avoids the temperature fluctuation of the water flow entering the carbon dioxide heat pump water heater 1, so that the water flow heated by the carbon dioxide heat pump water heater 1 will not have temperature fluctuations, and finally the water flow entering the first heat exchange tube 21 can also maintain a stable temperature, and the heat output from the heat exchanger 2 to the secondary side water supply pipeline 20 is relatively stable, and finally enables the water flow output from the secondary side water supply pipeline 20 to maintain a stable temperature.

In this embodiment, the return water outlets 41 are uniformly distributed sequentially from the bottoms of the return water tanks 4 to the tops of the return water tanks 4 to reduce the temperature difference between the incoming water flow and the water in the return water tanks 4.

The primary side loop 10 further comprises a water supply tank 6, and two upper ends of the water supply tank 6 are respectively connected to a water supply inlet 61 of the carbon dioxide heat pump water heater 1 and a water supply outlet 62 of the first heat exchange tube 21. A lower portion of the water supply tank 6 and upper portions of the return water tanks 4 are arranged in communication with each other through water pipes 9. When the water temperature of the hot water flowing from the carbon dioxide heat pump water heater 1 fluctuates, the water supply tank 6 can play a buffering role, after the hot water with fluctuating water temperature is mixed into the original hot water in the water supply tank 6, the fluctuation range is reduced, which further reduces the water temperature fluctuation of the water flowing out of the water supply outlet 62.

A water supply temperature sensor 63 is arranged on the water supply tank 6 near the water supply outlet 62, and a water supply bottom temperature sensor 64 is arranged at the bottom of the water supply tank 6, to monitor the water temperature difference at the top and bottom of the water supply tank 6, respectively.

A primary side water supply pump 7 is arranged between the return water outlet 41 and the carbon dioxide heat pump water heater 1. A primary side circulation pump 8 is arranged between the water supply tank 6 and the inlet of the first heat exchange tube 21. The primary side water supply pump 7 is used to send the water flow from the bottom of the return water tank 4 to the carbon dioxide heat pump water heater 1 for heating, and the primary side circulation pump 8 can assist the water flow circulation of the primary side loop 10.

In addition, a water supplement port 45 is further arranged in the primary side loop 10, and to prevent the water temperature fluctuation caused by the supplement, the water supplement port 45 is arranged at the bottoms of the return water tanks 4, so that the supplemented cold water can be rapidly heated by the carbon dioxide heat pump water heater 1 after entering the primary side loop 10.

In addition, in this embodiment, a secondary side circulation pump 31 is arranged in the secondary side water supply pipeline 20, and a secondary side inlet water temperature sensor 32 and a secondary side outlet water temperature sensor 33 are respectively arranged at the inlet end and the outlet end of the secondary side water supply pipeline 20. The secondary side circulation pump 31 is arranged close to the inlet end, which can prevent the secondary side circulation pump 31 from being damaged due to idling when the heat exchanger 2 is blocked.

The control method of the secondary side water supply pipeline 20 is adjusting the operating frequency V of the secondary side circulation pump 31 through the relationship between the temperature difference Δt between the secondary side inlet water temperature $T_{2i}$ detected by the secondary side inlet water temperature sensor 32 and the return water temperature $T_{10}$ detected by the return water temperature sensor 5 and the target difference ΔT, to output hot water with a stable water temperature.

Specifically, $$\Delta t = T_{10} - T_{2i};$$

$$\Delta T = a * T_{10}/T_{2i} + b;$$

where a and b are empirical parameters.

When $\Delta T - c \leq \Delta t \leq \Delta T + c$, keeping the frequency of the secondary side circulation pump 31 unchanged; when $\Delta t < \Delta T - c$, decreasing the frequency of the secondary side circulation pump 31; when $\Delta t > \Delta T + c$, increasing the frequency of the secondary side circulation pump 31, until $\Delta T - c \leq \Delta t \leq \Delta T + c$, wherein c is the temperature tolerance, which is taken as an integer according to the actual situation, the recommended value range is 2~5, and which can also be customized by those skilled in the art according to the actual situation.

Therefore, the operating frequency V of the secondary side circulation pump 31 can be adjusted according to the water temperature fluctuation of the water inlet of the secondary side water supply pipeline 20, thereby further reducing the water temperature fluctuation of the water outlet of the secondary side water supply pipeline 20.

The embodiments described above are only for illustrating the technical concepts and features of the present disclosure, and are intended to make those skilled in the art being able to understand the present disclosure and thereby implement it, and should not be concluded to limit the protective scope of this disclosure. Any equivalent variations or modifications according to the essence of the present disclosure should be covered by the protective scope of the present disclosure.

The invention claimed is:

1. A control method for a constant-temperature water supply system employing a carbon dioxide heat pump, it adopting a constant-temperature water supply system employing a carbon dioxide heat pump, the constant-temperature water supply system comprises:

a primary side loop;

a secondary side water supply pipeline having a water inlet and a water outlet;

a heat pump water heater provided in the primary side loop; and a heat exchanger provided between the primary side loop and the secondary side water supply pipeline, wherein the heat exchanger comprises a first heat exchange tube and a second heat exchange tube arranged to exchange heat with each other, the first heat exchange tube is arranged in the primary side loop, the second heat exchange tube is arranged in the secondary side water supply pipeline, and the primary side loop and the secondary side water supply pipeline are connected to each other in a heat exchange manner through the heat exchanger, wherein the primary side loop further comprises at least one vertically arranged return water tank, a bottom of the return water tank is provided with a return water outlet that communicates with the heat pump water heater, a side portion of the return water tank is provided with a plurality of return water inlets connected to the heat exchanger in a vertical direction in sequence, each of the return water inlets is provided with a return water valve, the return water tank is provided with a plurality of return water tank temperature sensors for detecting water temperature in the return water tank corresponding to a height of each of the return water inlets, and an outlet of the first heat exchange tube is provided with a return water temperature sensor for detecting temperature of the water at the outlet of the first heat exchange tube, and wherein the control method comprises:

detecting a first water temperature at the outlet of the first heat exchange tube by the return water temperature sensor;

detecting second water temperatures at different heights of the return water tank by the plurality of return water tank temperature sensors;

comparing differences between the first water temperature and each of the second water temperatures; and opening a return water valve corresponding to a return water tank temperature sensor of the plurality of return water tank temperature sensors associated with a smallest difference of the differences to return water.

2. The control method according to claim 1, wherein the primary side loop comprises n return water tanks vertically arranged in parallel, a side portion of the return water tank is provided with m return water inlets connected to the heat exchanger in a vertical direction in sequence, and the return water tank temperature sensor on the return water tanks 4 has n*m groups;

the control method comprises:

1) detecting a temperature $T_{10}$ of the return water by the return water temperature sensor, and detecting a temperature $T_{Ni}$ of the return water tank by the n*m groups of return water tank temperature sensors;

2) comparing $T_{10}$ with $T_{Ni}$, there are three cases:

a) $T_{10}$ is between two adjacent $T_{Ni}$; at this time, opening the return valve corresponding to the return water tank temperature sensor with the lower temperature in the two adjacent $T_{Ni}$, and the primary side return water returns there;

b) $T_{10} \geq$ the maximum value of $T_{Ni}$; at this time, opening the return water valve corresponding to the return water tank temperature sensor with the maximum value of $T_{Ni}$, and the primary side return water returns there; and c) $T_{10} \leq$ the minimum value of $T_{Ni}$, at this time, opening the return water valve corresponding to the return water tank temperature sensor with the minimum value of $T_{Ni}$, and the primary side return water returns there.

3. The control method according to claim 1, wherein the control method comprises the control of the secondary side water supply pipeline, comprising:

adjusting an operating frequency V of a secondary side circulation pump through the relationship between the temperature difference $\Delta t$ between a secondary side inlet water temperature $T_{2i}$ detected by a secondary side inlet water temperature sensor and a return water temperature $T_{10}$ detected by the return water temperature sensor and a target difference $\Delta T$, to output hot water with a stable water temperature, wherein $\Delta t = T_{10} - T_{2i}$ and $\Delta T = a * T_{10}/T_{2i} + b$, and wherein a and b are empirical parameters.

4. The control method according to claim 3, wherein in the control method comprises:

when $\Delta T - c \leq \Delta t \leq \Delta T + c$, keeping the frequency of the secondary side circulation pump unchanged;

when $\Delta t < \Delta T - c$, decreasing the frequency of the secondary side circulation pump; and when $\Delta t > \Delta T + c$, increasing the frequency of the secondary side circulation pump, until $\Delta T - c \leq \Delta t \leq \Delta T + c$, wherein c is a temperature tolerance.

5. The control method according to claim 1, wherein the return water inlets are uniformly distributed in sequence from the bottom of the return water tank to a top of the return water tank.

6. The control method according to claim 1, wherein the primary side loop further comprises a water supply tank, and two ends of an upper portion of the water supply tank are respectively connected to an outlet of the heat pump water heater and an inlet of the first heat exchange tube.

7. The control method according to claim 6, wherein a water supply temperature sensor is arranged at an outlet end of the water supply tank, and a water supply bottom temperature sensor is arranged at a bottom of the water supply tank.

8. The control method according to claim 1, wherein a primary side water supply pump is arranged between the return water outlet and the heat pump water heater.

9. The control method according to claim 6, wherein the primary side loop is further provided with a primary side circulation pump, and the primary side circulation pump is arranged between the water supply tank and the inlet of the first heat exchange tube.

10. The control method according to claim 1, wherein a secondary side inlet water temperature sensor and a secondary side outlet water temperature sensor are respectively arranged at an inlet end and an outlet end of the secondary side water supply pipeline.

11. The control method according to claim 1, wherein a water supplement port is arranged at the bottom of the return water tank.

12. The control method according to claim 6, wherein a water pipe is further provided between a top of the return water tank and a bottom of the water supply tank, and the water pipe is used to transport water at the top of the return water tank into the water supply tank.

13. The control method according to claim 1, wherein directions of water flow in the first heat exchange tube and the second heat exchange tube are opposite.

14. The control method according to claim 1, wherein a secondary side circulation pump is arranged in the secondary side water supply pipeline, a secondary side inlet water temperature sensor and a secondary side outlet water temperature sensor are respectively arranged at an inlet end and an outlet end of the secondary side water supply pipeline, and the secondary side circulation pump is close to the inlet end.

* * * * *